US005769037A

United States Patent [19]

Ohtsubo et al.

[11] Patent Number: 5,769,037

[45] Date of Patent: Jun. 23, 1998

[54] HOLLOW VALVE IN AN INTERNAL COMBUSTION ENGINE

[75] Inventors: Kizuku Ohtsubo, Kawasaki; Takeji Kenmoku, Fujisawa, both of Japan

[73] Assignee: Fuji Oozx, Inc., Kanagawa-ken, Japan

[21] Appl. No.: 789,008

[22] Filed: Jan. 27, 1997

[51] Int. Cl.[6] ..... F01L 3/14

[52] U.S. Cl. ..... 123/41.34; 123/188.9; 29/888.45

[58] Field of Search ..... 123/188.3, 188.9, 123/41.34; 29/888.45, 888.451, 888.452, 888.453

[56] References Cited

U.S. PATENT DOCUMENTS

| | | | |
|---|---|---|---|
| 1,501,862 | 7/1924 | Midgley, Jr. | 123/188.9 |
| 1,670,965 | 5/1928 | Heron | 29/888.45 |
| 1,699,273 | 1/1929 | Bissell | 29/888.45 |
| 3,233,599 | 2/1966 | Schober | 29/888.45 |
| 3,378,904 | 4/1968 | Prasse et al. | 29/888.45 |
| 3,710,773 | 1/1973 | Piech et al. | 29/888.45 |
| 4,190,941 | 3/1980 | Charron | 123/41.34 |
| 4,406,046 | 9/1983 | Adam et al. | 29/888.45 |
| 4,459,949 | 7/1984 | Weintz | 123/41.34 |
| 5,458,314 | 10/1995 | Bonesteel | 123/188.3 |

FOREIGN PATENT DOCUMENTS

| | | |
|---|---|---|
| 695567 | 8/1940 | Germany . |
| 60-145410 | 7/1985 | Japan . |
| 63-151911 | 10/1988 | Japan . |
| 4047106 | 2/1992 | Japan . |
| 4124416 | 4/1992 | Japan . |
| 5071316 | 3/1993 | Japan . |
| 224288 | 11/1924 | United Kingdom . |

*Primary Examiner*—Erick R. Solis
*Attorney, Agent, or Firm*—Oppenheimer Poms Smith

[57] ABSTRACT

A hollow valve is used as an inlet or exhaust valve in an internal combustion engine. A hollow valve has a valve head and a valve stem. A cavity extends from the valve head to the valve stem. A low melting point alloy in solid is inserted into the cavity and occupies ¼ to ⅓ of the cavity in volume. During operation of the engine, the alloy is melted, thereby cooling the valve.

7 Claims, 2 Drawing Sheets

HOLLOW VALVE IN AN INTERNAL COMBUSTION ENGINE

BACKGROUND OF THE INVENTION

The present invention relates to a hollow valve used as an inlet or exhaust valve in an internal combustion engine.

Recently, in a gasoline engine, it is strongly required to carry out high output and low fuel expenses. As means for performing high output, a supercharger is provided, or allowable rotation speed for the engine is increased. For performing low fuel expenses, lean-burn type engine is provided.

However, if engine performance is improved by the above means, combustion temperature increases. Especially, thermal load to an exhaust valve increases, so that valve head becomes high temperature, and high temperature strength decreases, thereby making it more difficult to employ a ordinary heat-resistant steel valve elements. If allowable rotation speed of the engine increases, inertia mass of the valve element increases, so that followability to a cam fails. It is required to lighten the valve element.

To satisfy the requirements to decrease thermal load to the valve head and to lighten the valve element, there is a hollow valve which contains metal Na as cooling medium in a cavity which extends from a valve head to a valve stem, as disclosed in Japanese patent Laid-Open pub. No.60-145410) and Japanese Utility Model Laid-Open pub. No.63-151911.

In the conventional hollow valve which contains metal Na, since metal Na is likely to react with $H_2O$ or $O_2$, $Na_2O$ or NaOH is formed by the reaction to increase internal pressure of the cavity or to decrease cooling efficiency. Thus, to manufacture the hollow valves, it is necessary to remove water content in the cavity completely and to insert metal Na in inert gas atmosphere, thereby making manufacturing process complicate.

Metal Na is solid at room temperature and melted at operating temperature of the valve element. But the melting point thereof is relatively low, such as about 98° C. Accordingly, metal Na has been already melted during warm-up operation of the engine or low speed operation right after running, and the valve head may be subjected to supercooling by heat exchange of metal Na. So self-cleaning action fails, so that combustion product which is contained in an exhaust gas or lubricating oil which drops owing to oil-down is adhered and deposited on the valve head.

SUMMARY OF THE INVENTION

To overcome the disadvantages, it is an object to provide a hollow valve in an internal combustion engine, wherein cooling medium other than metal Na is enclosed in a cavity, thereby facilitating manufacture and preventing a valve head from being subjected to supercooling.

According to the present invention, there is provided a hollow valve in an internal combustion engine, the valve comprising:

a valve head;

a valve stem; and a cavity which is formed in the valve head and the valve stem, a low melting point alloy being enclosed in the cavity.

Therefore, manufacturing is facilitated and becomes low cost.

BRIEF DESCRIPTION OF THE DRAWINGS

The features and advantages of the invention will become more apparent from the following description with respect to embodiments based on accompanying drawings wherein.

DETAILED DESCRIPTION OF PREFERRED EMBODIMENTS

Figure 1:
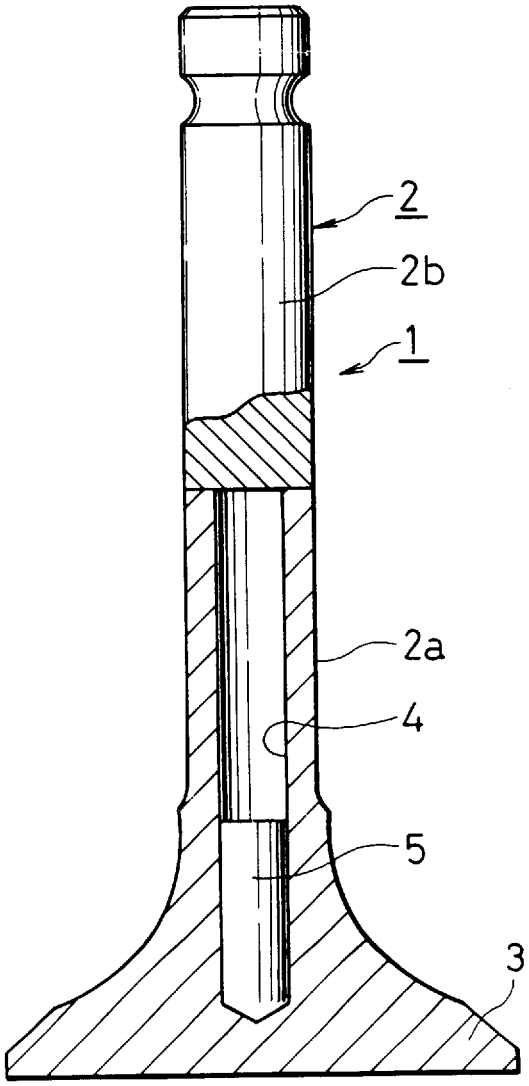
FIG. 1 is a partially cut-out front elevational view of one embodiment of the present invention.

FIG. 1 illustrates a hollow valve in which a valve element 1 comprises a valve stem 2 and a valve head 3. The valve stem 2 comprises a hollow valve stem portion 2*a* near the valve head 2*a* and a solid valve stem portion 2*b*. A cavity 4 is formed on an axis from the vicinity of the lower end of the valve head 3 to the solid valve stem portion 2*b*.

A rod-like low melting point alloy 5 as cooling medium is inserted in the cavity 4 to occupy ¼ to ⅓ of the cavity 4 in volume when it is melted. The opening end of the hollow valve stem portion 2*a* is closed by connecting the solid valve stem portion 2*a* with friction welding after the low melting point alloy 5 is enclosed in the cavity 4.

Why the low melting point alloy 5 occupies ¼ to ⅓ of the cavity is that cooling effect would not be achieved if it is below the range, and that if it is above the range, space required to move the melted low melting point alloy 5 up and down would decrease to fail in shaking effect, thereby decreasing heat exchange and increasing weight of the valve element 1.

The low melting point alloy 5 may preferably be an alloy which contains 42% by weight of Sn and 58% by weight of Bi and has a melting point of 138° C. an alloy which contains 40% by weight of Sn, 56% by weight of Bi and 4% by weight of Zn and has a melting point of 130° C. or an alloy which contains 30% by weight of Sn, 57% by weight of Bi and 13% by weight of Zn and has a melting point of 127° C.

The melting point of the low melting point alloy 5 may be 120° to 200° C. Preferably 150°±20° C. and can be easily determined by choosing ratio of each clement of the alloy which is described as above. The reasons for the range of the melting point is that the valve head is liable to be subject to supercooling by melting it during warm-up operation of an engine similar to metal Na in the prior art as above if it is below 120° C. and that cooling initiation temperature of the valve element I would become higher to decrease cooling effect of the valve head 3 if it is above 200° C.

Figure 2:
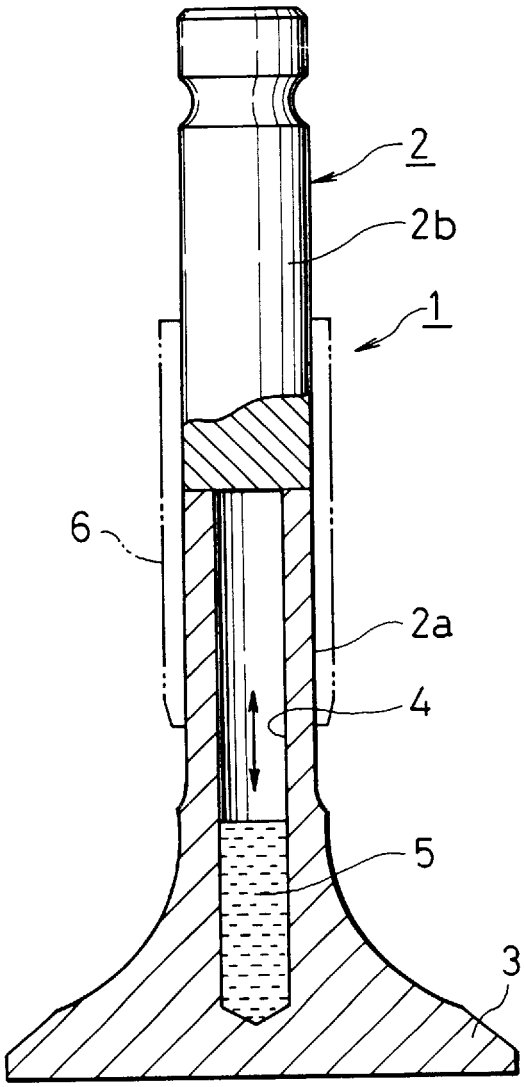
FIG. 2 is a partially cut-out front elevational view which illustrates melting of low melting point alloy thereof.

FIG. 2 illustrates that the low melting point alloy is melted in the cavity 4 by the operating temperature of the valve element I when the hollow valve in the foregoing embodiment is assembled in an engine. When the valve head 3 is heated to high temperature by combustion gas, heat is transferred to the upper portion of the valve stem 2 through the low melting point alloy 5 which moves up and down in the cavity 4, and further to a cylinder head (not shown) via a valve guide 6, thereby decreasing thermal load in the valve head 2.

As mentioned above, in the present invention, the low melting point alloy 5 is enclosed in the cavity 4, thereby omitting complicate manufacturing processes in a conventional valve which contains metal Na to decrease manufacturing cost.

The low melting point alloy has higher melting point than metal Na. Thus, when the temperature of the valve clement is still low, such as during warm-up operation, it is melted and the valve head is not subjected to supercooling, thereby preventing combustion product or lubricating oil owing to oil-down from adhering onto the valve head 3.

The present invention is not limited to the foregoing embodiments. For example, Sn—In alloy may be used as the low melting point alloy 5 if high cost is not taken into account. In the embodiment. the low melting point alloy 5 is inserted in the cavity like a rod, but may be pressed in as powder or compressed powder. The inner circumferential surface of the cavity 4 may be treated with high thermal conductive material or material which has good affinity with the low melting point alloy 5, thereby increasing wettability of the low melting point alloy 5. Thus, thermal transfer efficiency is increased, so that cooling effect in the valve head becomes larger. Of course, the cavity 4 is not restricted in form to the foregoing embodiments. For example, the cavity 3 may become larger gradually in diameter towards the valve head.

The foregoings merely relate to embodiments of the present invention. Various modifications and changes may be made by person skilled in the art without departing from the scope of claims wherein:

What is claimed is:

1. A hollow valve in an internal combustion engine, the valve comprising:

a valve head;

a valve stem; and a cavity which is formed in the valve head and the valve stem, a low melting point alloy being enclosed in the cavity;

wherein the low melting point alloy contains Sn and Bi.

2. The hollow valve as defined in claim 1 wherein the low melting point alloy occupies ¼ to ⅓ of the cavity in volume.

3. The hollow valve as defined in claim 1 wherein the low melting point alloy has a melting point of 120° to 200° C.

4. The hollow valve as defined in claim 3 wherein the low melting point alloy has a melting point of 130° to 170° C.

5. The hollow valve as defined in claim 1 wherein the low melting point alloy contains 40 to 45% by weight of Sn and 55 to 60% by weight of Bi.

6. The hollow valve as defined in claim 1 wherein the low melting point alloy also contains Zn.

7. The hollow valve as defined in claim 6 wherein the low melting point alloy contains 30to 40% by weight of Sn, 55 to 60% by weight of Bi and 3to 15% of by weight of Zn.

* * * * *